US007121409B1

(12) United States Patent
Hamilton et al.

(10) Patent No.: US 7,121,409 B1
(45) Date of Patent: Oct. 17, 2006

(54) DISPENSING SACHET BY BENDING AND METHOD OF SACHET MANUFACTURE

(75) Inventors: Colin Henry Hamilton, Milperra (AU); Peter Charles Wilson, Sydney (AU); William Louis Pittelkow, Curl Curl (AU)

(73) Assignee: Snap Pak Industries (AUST) Pty Ltd., Milperra (AU)

( * ) Notice: Subject to any disclaimer, the term of this patent is extended or adjusted under 35 U.S.C. 154(b) by 165 days.

(21) Appl. No.: 10/070,870

(22) PCT Filed: Sep. 4, 2000 (Under 37 CFR 1.47)

(86) PCT No.: PCT/AU00/01052

§ 371 (c)(1), (2), (4) Date: Nov. 14, 2002

(87) PCT Pub. No.: WO01/17875

PCT Pub. Date: Mar. 15, 2001

(30) Foreign Application Priority Data

Sep. 2, 1999 (AU) ..... PQ2615
Sep. 1, 2000 (WO) ..... PCT/AU00/01044

(51) Int. Cl.
*B65D 47/10* (2006.01)
*B65D 73/00* (2006.01)

(52) U.S. Cl. ..... 206/484.2; 206/484; 222/541.6; 222/541.4

(58) Field of Classification Search ..... 206/531, 206/532, 461, 469, 484, 447, 484.2; 222/153.05, 222/153.06, 541.1, 541.6, 105, 107, 541.4, 222/541.5

See application file for complete search history.

(56) References Cited

U.S. PATENT DOCUMENTS

| | | | | |
|---|---|---|---|---|
| 3,948,394 | A | 4/1976 | Hellstrom | |
| 3,986,640 | A | 10/1976 | Redmond | |
| 4,236,652 | A | 12/1980 | Beguhn | |
| 4,371,080 | A | 2/1983 | Haines | |
| 4,493,574 | A | 1/1985 | Redmond et al. | |
| 4,611,715 | A | 9/1986 | Redmond | |
| 4,884,694 | A * | 12/1989 | Sengewald | 206/484.1 |
| 5,009,894 | A | 4/1991 | Hsiao | |

(Continued)

FOREIGN PATENT DOCUMENTS

AU 199665366 B2 7/1996

(Continued)

*Primary Examiner*—Mickey Yu
*Assistant Examiner*—J. Gregory Pickett
(74) *Attorney, Agent, or Firm*—Knobbe, Martens, Olson & Bear LLP

(57) ABSTRACT

A sachet [(10, 22, 110, 210, 510)] for the packaging and dispensing of an item or a flowable substance [(125)], such as a liquid, powder or paste, has a semi-rigid member [(112)] with a weakened region [(120)] formed thereon so that upon bending across the weakened region [(120)] the semi-rigid member [(112)] will fracture along the weakened region [(120)]. The sachet [(110)] also has a reservoir [(114)] formed by overlaid first and second flexible film layers [(116,118)] which are adapted to contain the flowable substance [(125)]. In one form, an annular region [(128)] of the second flexible film layer [(118)] immediately surrounding the aperture region [(126)] is sealed to the adjacent region of the semi-rigid member [(112)] so as to prevent leakage of the flowable substance [(125)] from within the reservoir [(114)]. In use, fracturing along the weakened region [(120)] will expose the aperture [(126)] so as to allow the flowable substance [(125)] to be dispensed.

8 Claims, 7 Drawing Sheets

U.S. PATENT DOCUMENTS 5,277,920 A * 1/1994 Weaver, Jr. ..... 206/469
5,529,188 A * 6/1996 Coggswell ..... 206/531
6,041,930 A * 3/2000 Cockburn ..... 206/484

FOREIGN PATENT DOCUMENTS

EP 0 667 303 A1 1/1995

* cited by examiner

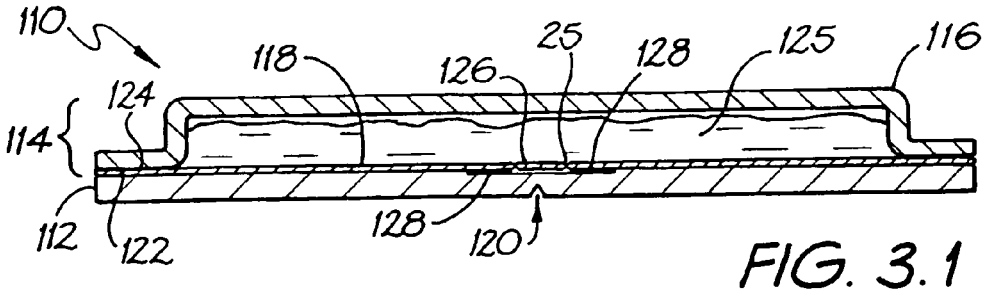
FIG. 3.1
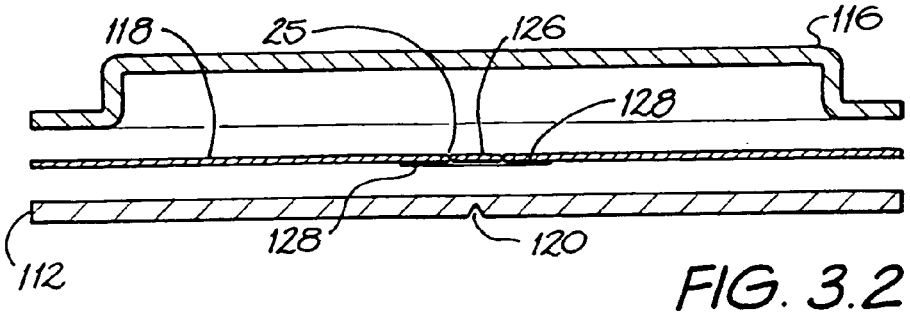
FIG. 3.2
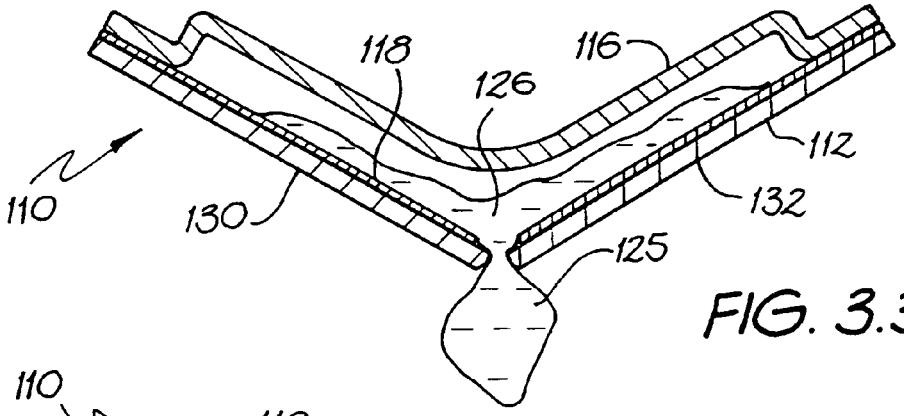
FIG. 3.3
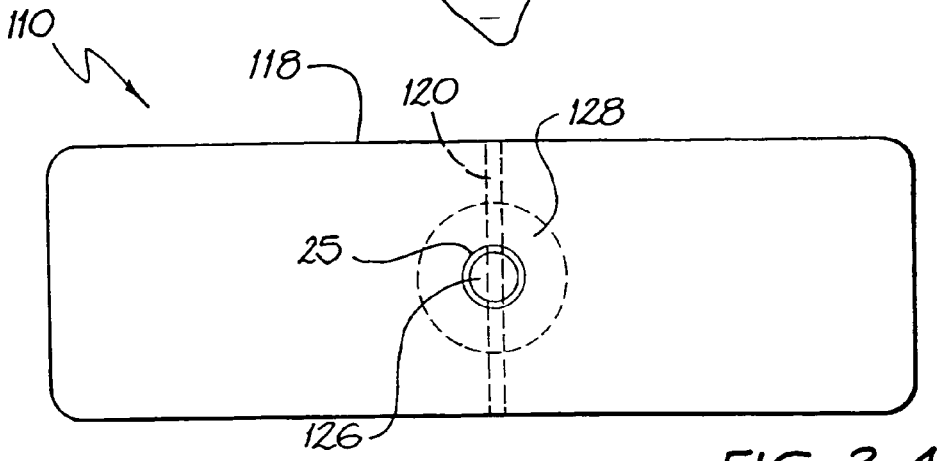
FIG. 3.4

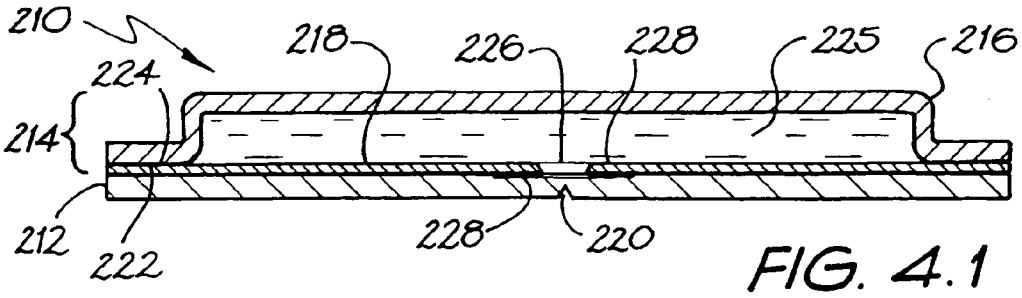
FIG. 4.1
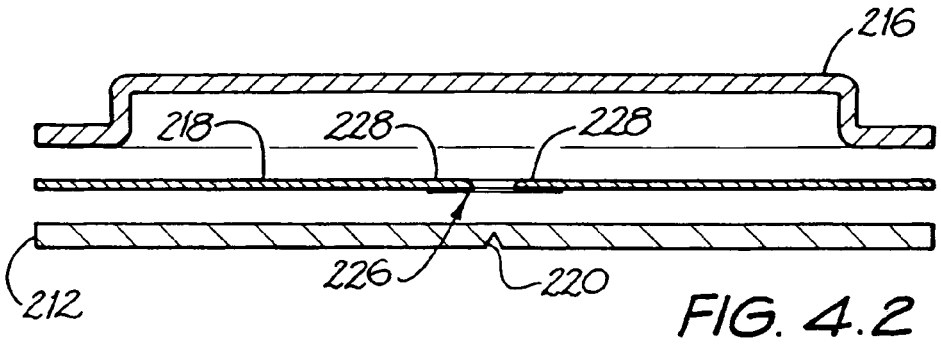
FIG. 4.2
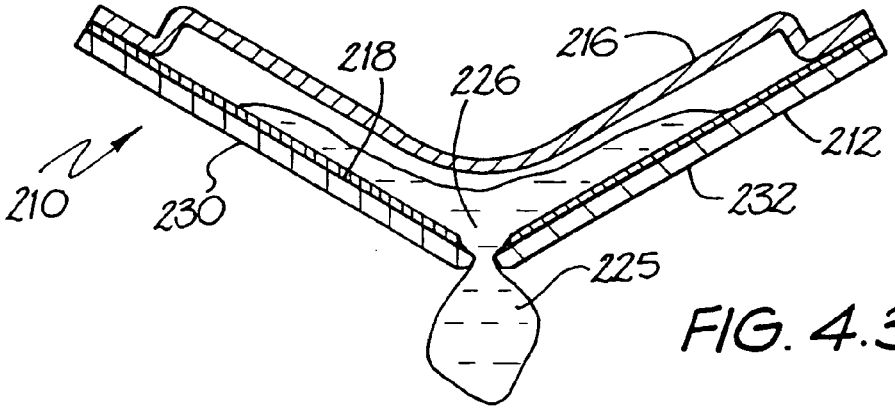
FIG. 4.3
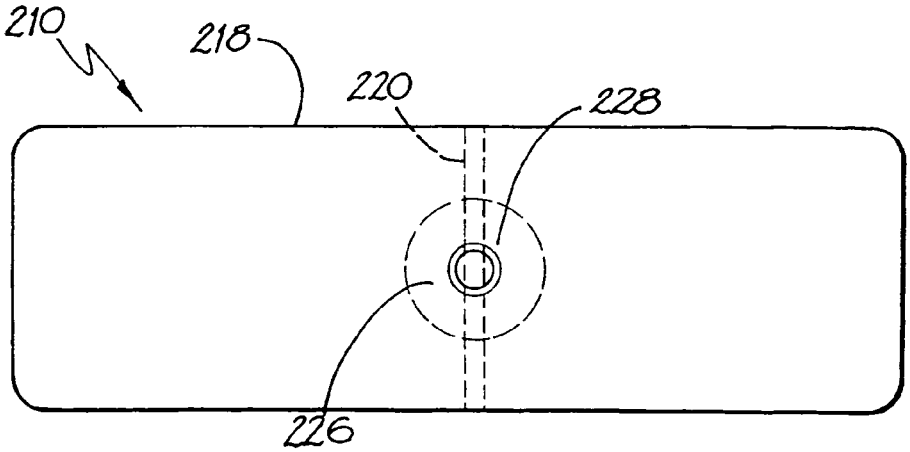
FIG. 4.4

DISPENSING SACHET BY BENDING AND METHOD OF SACHET MANUFACTURE

FIELD OF INVENTION

The present invention relates to a sachet of the type which forms both a container for and dispenser of selected items as well as predetermined quantities of flowable substances such as liquids, powders and pastes and, more particularly, to such a sachet and a method of manufacture thereof.

BACKGROUND

The concept of a sachet for storing and dispensing of a single serve of a condiment such as tomato sauce or the like is known. See, for example, a selection of patents to Sanford Redmond including U.S. Pat. No. 4,493,574 and U.S. Pat. No. 4,611,715 which show a sachet arrangement having a ridge portion through which condiment is expressed.

Australian Patent Application 65366/96 discloses an alternative arrangement which utilizes a flat rather than ridge like dispenser arrangement.

Sachets have also been used to store and protect specific items prior to use. Such items can include but are by no means limited to liquid impregnated articles such as tissues and swabs of various kinds. In this context the aperture for expression of the stored article will often need to be larger than in the case where a flowable substance such as a paste or cream is to be expressed.

A problem with both the raised and non-raised arrangements referred to above relates to the sealing of the dispenser aperture during the period when the sachet is being used for storage and, in conjunction with this, the manner of opening or rupturing of the aperture at the time of first use of the sachet to dispense its contents. Particularly where the sachet is not disposed of after initial expulsion of its contents but, rather, is retained for further or subsequent expulsion of contents at a later time problems occur with interaction between the remaining contents of the sachet and the ruptured opening, including in some instances, the degradation of portions of the sachet.

It is an object of the present invention to address or ameliorate one or more of the abovementioned problems or at least provide a useful choice.

BRIEF DESCRIPTION OF INVENTION

Accordingly, in one broad form of the invention there is provided a sachet comprising a tray portion to which is non-releasably sealably affixed a composite releasably sealable structure.

Preferably said composite releasably sealable structure comprises at least a first layer overlaying a second layer.

Preferably said first layer comprises a semi-rigid member.

Preferably said second layer comprises a second upper film layer.

Preferably said composite releasably sealable structure includes an aperture region therein.

Preferably said aperture region comprises a first sub-aperture region in said first layer in communication with a second sub-aperture region located in said second layer.

Preferably said first sub-aperture region comprises a score line in said first layer.

In an alternative preferred form said second sub-aperture region comprises an aperture in said second layer.

Preferably said second sub-aperture region comprises a rupturable film component.

Preferably said first layer is sealed to said second layer at said aperture region.

Preferably said seal remains intact after first rupture of said aperture region.

In yet a further broad form of the invention there is provided a method of forming a sachet, said sachet comprising a tray portion to which is non-releasably sealably affixed a composite releasably sealable structure; said method comprising the steps of:

(a) forming an array of indentations in a film layer, each indentation corresponding to said tray portion;

(b) injecting a flowable substance into said indentations;

(c) placing an upper sheet assembly corresponding to said composite releasably sealable structure over said array of indentations;

(d) non-releasably sealing peripheral portions of said indentations to said upper sheet assembly thereby to form an array of sachets.

Preferably said steps are performed in a batch mode.

In yet a further broad form of the invention there is provided a sachet for the packaging and dispensing of an item or a flowable substance, said sachet comprising a semi-rigid member having formed thereon a weakened region so that upon bending across said weakened region said semi-rigid member will fracture along said weakened region, a reservoir means formed by overlaid first and second flexible film layers and adapted to contain said item or flowable substance, said second flexible film layer being affixed upon said semi-rigid member, the region of the said second flexible film layer immediately surrounding an aperture or aperture region being sealed to the adjacent region of the said semi-rigid member so as to prevent leakage of said item or flowable substance from within the said reservoir means, whereby fracturing along said weakened region will expose the said aperture so as to allow said item or flowable substance to be dispensed.

Preferably at least one of said film layers includes an aperture therethrough at a location proximate to said weakened region.

Preferably at least one of said film layers includes an aperture region therethrough at a location proximate to said weakened region.

Preferably said weakened region comprises a score line across said semi-rigid member.

Preferably the first and second flexible film layers comprise separate flexible film members affixed together at their respective peripheral regions.

BRIEF DESCRIPTION OF DRAWINGS

Embodiments of the present invention will now be described with reference to the accompanying drawings wherein:

FIG. 3 comprises views of a sachet according to a first embodiment of the present invention;

FIG. 4 comprises views of a sachet according to a second embodiment of the present invention;

DETAILED DESCRIPTION OF PREFERRED EMBODIMENTS

Figure 1:
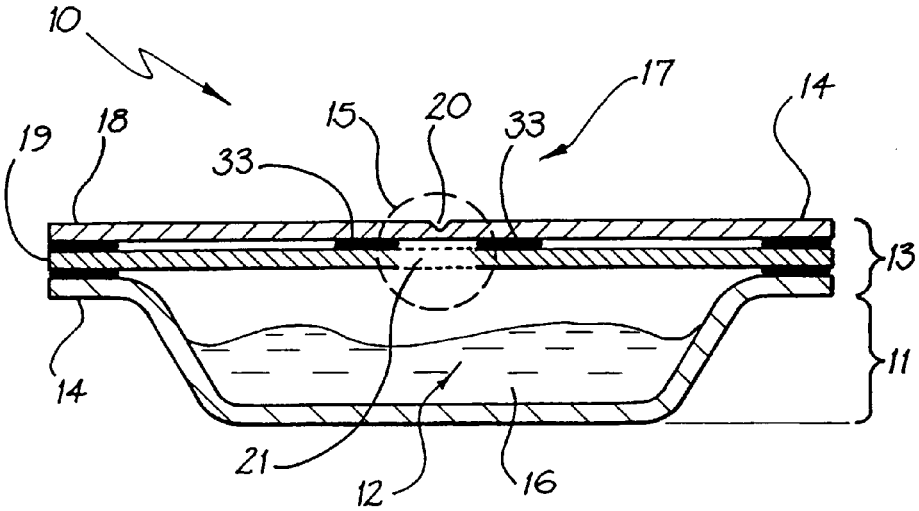
FIG. 1 is a side section view of a sachet according to a generalized first embodiment of the present invention.

With reference to FIG. 1 there is illustrated in side section view a sachet 10 in generalized form. The sachet 10 comprises a tray portion 11 defining a storage volume 12 therein. The storage volume 12 is releasably sealed by composite releasably sealable structure 13 which, as illustrated in FIG. 1, overlays the storage volume 12 defined by tray portion 11.

The composite releasably sealable structure 13 is non-releasably sealed to tray portion 11 at peripheral portions 14 thereof.

The sachet 10 includes an aperture region 15 in and forming part of composite releasably sealable structure 13. The aperture region 15 is adapted, following an initial rupture process, to conduct in a releasably sealable manner an item or a flowable substance 16 stored within storage volume 12 to exterior region 17.

In this embodiment composite releasably sealable structure 13 comprises a semi-rigid member 18 overlaying a 20 second upper film layer 19.

Aperture region 15 extends through both semi-rigid member 18 and second upper film layer 19 and comprises, in this instance, a first sub-aperture region 20 in semi-rigid member 18 and a second sub-aperture region 21 in second upper film layer 19. The first region 20 and second region 21 co-act to form aperture region 15 which, in conjunction with semi-rigid member 18 and second upper film layer 19 and characteristics thereof form a releasably sealable aperture in composite releasably sealable structure 13.

Figure 2:
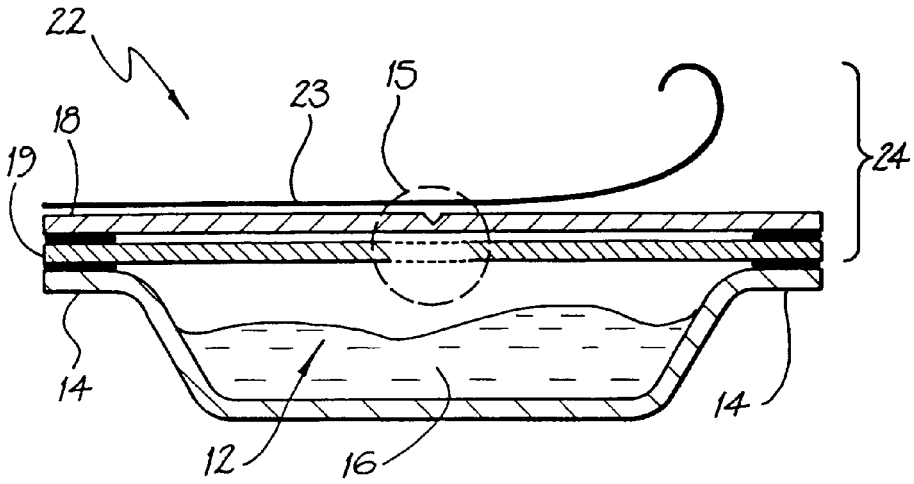
FIG. 2 is a side section view of a sachet according to a second generalized embodiment of the present invention.

With reference to FIG. 2 where like components are numbered as for FIG. 1 sachet 22 according to a second generalized embodiment of the invention includes an overlay layer 23 which overlays at least aperture region 15 and is releasably sealable thereto. Hence, in this arrangement, composite releasably sealable structure 24 comprises 3, in this instance substantially co-extensive, layers being second upper film layer 19, semi-rigid member 18 and overlay layer 23.

In the case of the embodiments of both FIG. 1 and FIG. 2 the arrangement is such that the sachets 10, 22 are filled, as part of the manufacture process to be described later in this specification, with an item or a flowable substance 16 placed in storage volume 12. At the time of manufacture the aperture region 15 is sealed thereby ensuring that storage volume 12 is a sealed volume up until the time it is desired by a user (not shown) to release at least a portion of the flowable substance 16 from storage volume 12.

At the time of intended first release of an item or flowable substance 16 through aperture region 15 a user causes aperture region 15 to be flexed sufficiently to cause rupture thereof so as to expose a releasably sealable channel therethrough and through which flowable substance 16 is urged by deformation of tray portion 11.

In a particularly preferred form the appropriate flexing of aperture region 15 together with sufficient deformation of tray portion 11 is performed in one movement by a user flexing downwardly peripheral portions 14 downwardly with respect to aperture region 15.

Upon ceasing of the flexing action the structure of the composite releasably sealable structure 13, 24 in conjunction with tray portion 11 is such that there is a natural tendency to return to the un-flexed state illustrated in FIG. 1 and FIG. 2. The arrangement can be such that some assistance will be required from the user to cause the structure to return completely to the state illustrated in FIG. 1 and FIG. 2. Once returned to this state aperture region 15 is re-sealed. In some embodiments the extent of sealing will be of less integrity than prior to first rupture but sufficient, from a practical point of view, to allow retention of at least a portion of the item or flowable substance 16 within storage volume 12 for subsequent release at a later time.

Overlay layer 23 can be utilized to reseal the aperture region 15 by drawing the overlay layer 23 thereover after use.

In various forms of alternative embodiment to be later described second sub-aperture region 21 can take the form of a passage in a central portion of second upper film layer 19. In alternative forms second sub-aperture region 21 can take the form of a rupturable seal located in a central portion of and formed from the same material as second upper film layer 19.

In further forms aperture region 15 can include a seal region 33 between semi-rigid member 18 and second upper film layer 19 extending at least entirely around and otherwise surrounding in sealable manner that portion of aperture region 15 which is subsequently ruptured so as to permit passage of flowable substance 16 therethrough.

The seal region 33 in its simplest form extends entirely around aperture region 15. It can be formed from an adhesive or can be formed by a heat seal between semi-rigid member 18 and second upper film layer 19.

In a further form seal region 33 can extend entirely through the region which is co-extensive between semi-regid member 18 and second upper film layer 19.

Two specific examples of the arrangements of FIG. 1 and FIG. 2 will now be described in detail followed by a particularly preferred method of filling and manufacture thereof.

First Detailed Embodiment

With reference to FIG. 3:

FIG. 3.1 is a sectional side elevation view of a sachet according to a detailed first preferred embodiment of the present invention;

FIG. 3.2 is a view similar to FIG. 1 but of the sachet in exploded form;

FIG. 3.3 is a sectional side elevation view of the sachet of FIG. 1 when bent sufficiently so as to fracture the semi-rigid member and expose the aperture for dispensing of the substance, and FIG. 3.4 is a top view of the sachet of FIG. 1 with the first flexible film layer and flowable substance removed so as to show the aperture and the sealed region thereabout.

The sachet 110 shown in FIGS. 3.1 to 3.4 has a semi-rigid member 112 and a reservoir means 114 formed by overlaid flexible film layers 116, 118.

The semi-rigid member 112 is, in this embodiment, fabricated of polystyrene, and has formed substantially midway across its elongate structure a weakened region comprising a score line 120, although the weakening may alternatively be due to perforations or narrowing of the structure or the like.

In addition or as an alternative to polystyrene, certain grades of PVC can be utilized for the semi-rigid member. Where PVC is utilized it may be necessary to include a scoreline on both sides of the semi-rigid member.

The weakened region 120 is such that upon bending thereacross, the semi-rigid member 112 will fracture or snap along the weakened region 120.

The overlaid flexible film layers 116, 118 are, in this embodiment, fabricated of polyester or, alternatively, plastic polymers or plastic laminates and comprise separate film members affixed together at their respective peripheral regions 122, 124, the film member 118 being first affixed upon the semi-rigid member 112. The film member 116 is so processed that, upon affixing on the film member 118, the film member 116 forms a loose pocket that co-operates with the film member 118 to form a flexible bag defining the reservoir means 114. A flexible bag defining the reservoir means 114 may alternatively be preformed utilizing a single film member that is folded over so as to form overlaid first and second flexible film layers that are then affixed together at their respective peripheral regions before the second flexible film layer is affixed upon the semi-rigid member 112.

In alternative particular forms the film can be a composite material comprising, for example, three layers including a seal layer, a barrier film and a printable polyester or nylon outer layer. Particular forms of film can include polymerised plastics such as LLDP, LDP, barrier films such as EVOH or PVdC coated PVC. In an alternative form aluminium foil film can be used as a barrier.

In further alternative forms, the film may comprise more generally plastic polymers or plastic laminates.

The reservoir means 114 contains a flowable substance 125, such as a liquid, powder or paste, in a measured quantity determined by the volume capacity of the flexible bag formed by the film layers 116, 118.

The peripheral regions 122, 124 of film layers 116, 118 respectively are affixed together by means of heat, heat activated glue or other sealing means. Similar sealing means may be used to affix at least the peripheral regions 124 of the film layer 118 upon the semi-rigid member 112.

The film layer 118 has an aperture region including a rupturable seal 126 comprised in this instance of a circular region of film layer 118 defined by a groove 25 or weakened circular path within the layer and at a location which corresponds to being proximate or overlapping the score line 120 formed laterally across the semi-rigid member 112 when affixed thereto. The aperture 126 is of such dimension as to allow the flowable substance 125 to flow controllably therethrough and is preferably circular.

An annular region 128 of the film layer 118 immediately surrounding the aperture region is bonded, or otherwise securely sealed, say, by a suitable heat activated glue that is inert to the effects of the flowable substance 125 contained in the reservoir means 114, to the adjacent region of the semi-rigid member 112 so as to prevent leakage or migration of the flowable substance 125 from within the reservoir means 114. In this manner, the flowable substance 125 is prevented from leaking to the peripheral regions of the semi-rigid member 112 where, as in the prior art, it may undermine the bond between the semi-rigid member 112 and the film layer 118 causing delamination thereof.

In alternative embodiments the region 128 may take other shapes including, for example, the shape of a cross.

The score line 120 is shown fractured in FIG. 3.3, such as by gripping each of the opposed shorter ends 130, 132 and bending the sachet 110 as shown until the semi-rigid member 112 snaps apart. The rupturable seal 126 is also ruptured by this action so that, in conjunction with the ruptured semi-rigid member, a releasably sealable channel in the aperture region is formed whereby flowable substance 125 may then be dispensed by squeezing the opposed shorter ends 130, 132 together with the thumb and forefinger of one hand.

The sachet of the present invention, as exemplified by reference to the preferred embodiment shown in FIGS. 3.1 to 3.4, therefore provides a superior, more user friendly, means of packaging and dispensing measured quantities of flowable substances, particularly those with aggressive properties, such as solvent-like or volatile substances.

Second Detailed Embodiment

With reference to FIG. 4, a second detailed embodiment will be described.

FIG. 4.1 is a sectional side elevation view of a sachet according to a preferred embodiment of the present invention;

FIG. 4.2 is a view similar to FIG. 1 but of the sachet in exploded form;

FIG. 4.3 is a sectional side elevation view of the sachet of FIG. 1 when bent sufficiently so as to fracture the semi-rigid member and expose the aperture for dispensing of the substance; and FIG. 4.4 is a top view of the sachet of FIG. 1 with the first flexible film layer and flowable substance removed so as to show the aperture and the sealed region thereabout.

The sachet 210 shown in FIGS. 4.1 to 4.4 has a semi-rigid member 212 and a reservoir means 214 formed by overlaid flexible film layers 216, 218.

The semi-rigid member 212 is, in this embodiment, fabricated of polystyrene, and has formed substantially midway across its elongate structure a weakened region comprising a score line 220, although the weakening may alternatively be due to perforations or narrowing of the structure or the like.

The weakened region 220 is such that upon bending thereacross, the semi-rigid member 212 will fracture or snap along the weakened region 220.

The overlaid flexible film layers 216, 218 are, in this embodiment, fabricated of polyester and comprise separate film members affixed together at their respective peripheral regions 222, 224, the film member 218 being first affixed upon the semi-rigid member 212. The film member 216 is so processed that, upon affixing on the film member 218, the film member 216 forms a loose pocket that co-operates with the film member 218 to form a flexible bag defining the reservoir means 214. A flexible bag defining the reservoir means 214 may alternatively be preformed utilizing a single film member that is folded over so as to form overlaid first and second flexible film layers that are then affixed together at their respective peripheral regions before the second flexible film layer is affixed upon the semi-rigid member 212.

The reservoir means 214 contains a flowable substance 225, such as a liquid, powder or paste, in a measured quantity determined by the volume capacity of the flexible bag formed by the film layers 216, 218.

The peripheral regions 222, 224 of film layers 216, 218 respectively are affixed together by means of heat, heat activated glue or other sealing means. Similar sealing means may be used to affix at least the peripheral regions 224 of the film layer 18 upon the semi-rigid member 212.

The film layer 218 has an aperture region including, in this instance an aperture 226 preformed therethrough at a location which corresponds to being proximate or overlapping the score line 220 formed laterally across the semi-rigid member 212 when affixed thereto. The aperture 226 is of such dimension as to allow the flowable substance 225 to flow controllably therethrough and is preferably circular.

An annular region 228 of the film layer 218 immediately surrounding the aperture 226 is bonded, or otherwise securely sealed, say, by a suitable heat activated glue that is inert to the effects of the flowable substance 225 contained in the reservoir means 214, to the adjacent region of the semi-rigid member 212 so as to prevent leakage or migration of the flowable substance 225 from within the reservoir means 214. In this manner, the flowable substance 225 is prevented from leaking to the peripheral regions of the semi-rigid member 212 where, as in the prior art, it may undermine the bond between the semi-rigid member 212 and the film layer 218 causing delamination thereof.

The score line 220 is shown fractured in FIG. 4.3, such as by gripping each of the opposed shorter ends 230, 232 and bending the sachet 210 as shown until the semi-rigid member 212 snaps apart. The aperture 226 is thus exposed and the flowable substance 225 may then be dispensed by squeezing the opposed shorter ends 230, 232 together with the thumb and forefinger of one hand.

The sachet of the present invention, as exemplified by reference to the preferred embodiment shown in FIGS. 4.1 to 4.4, therefore provides a superior, more user friendly, means of packaging and dispensing measured quantities of flowable substances, particularly those with aggressive properties, such as solvent-like or volatile substances.

Method of Manufacture

Figure 5:
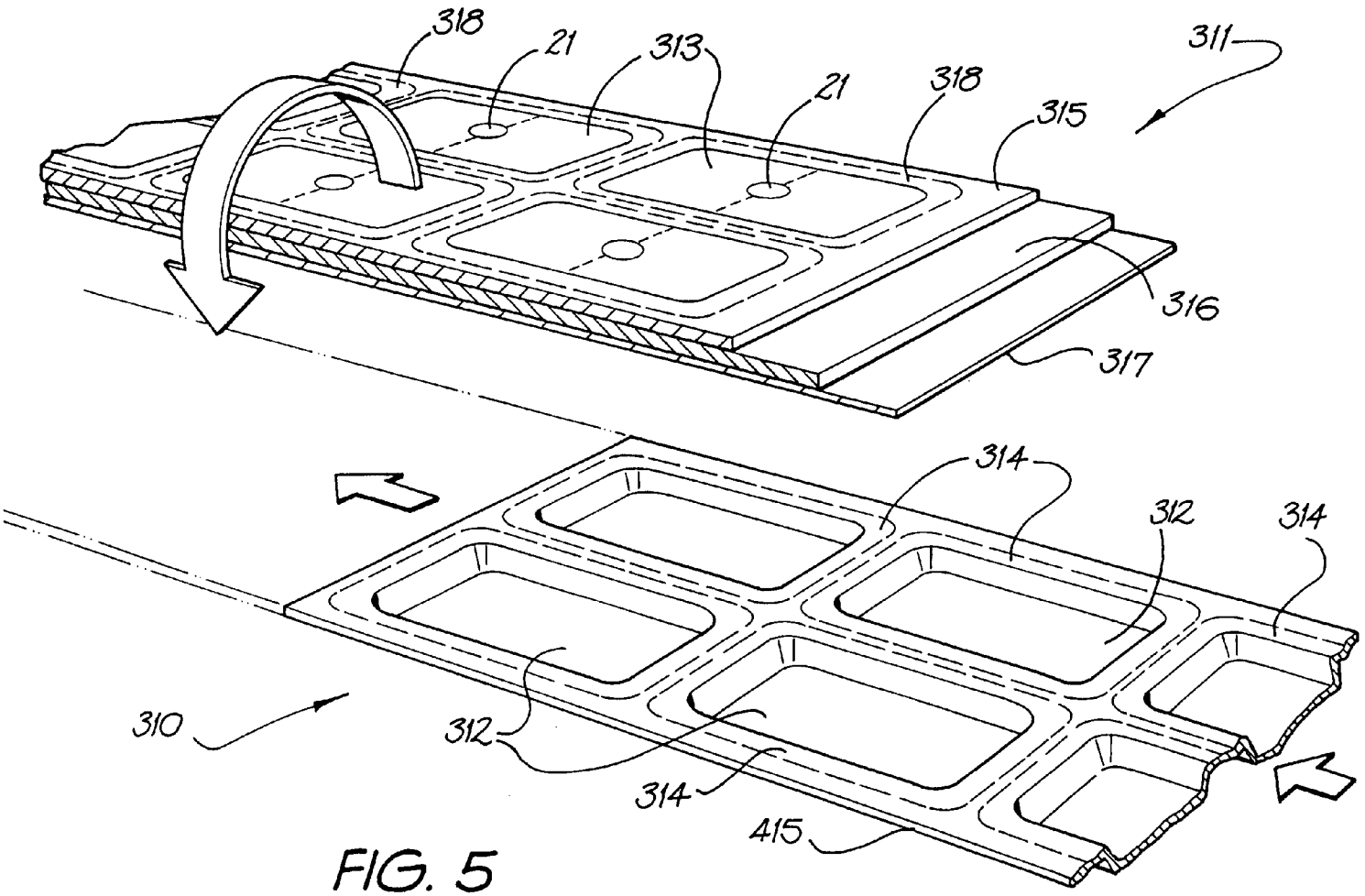
FIG. 5 illustrates a manner of assembly of a sachet of the type illustrated in either FIG. 3 or FIG. 4.
Figure 6:
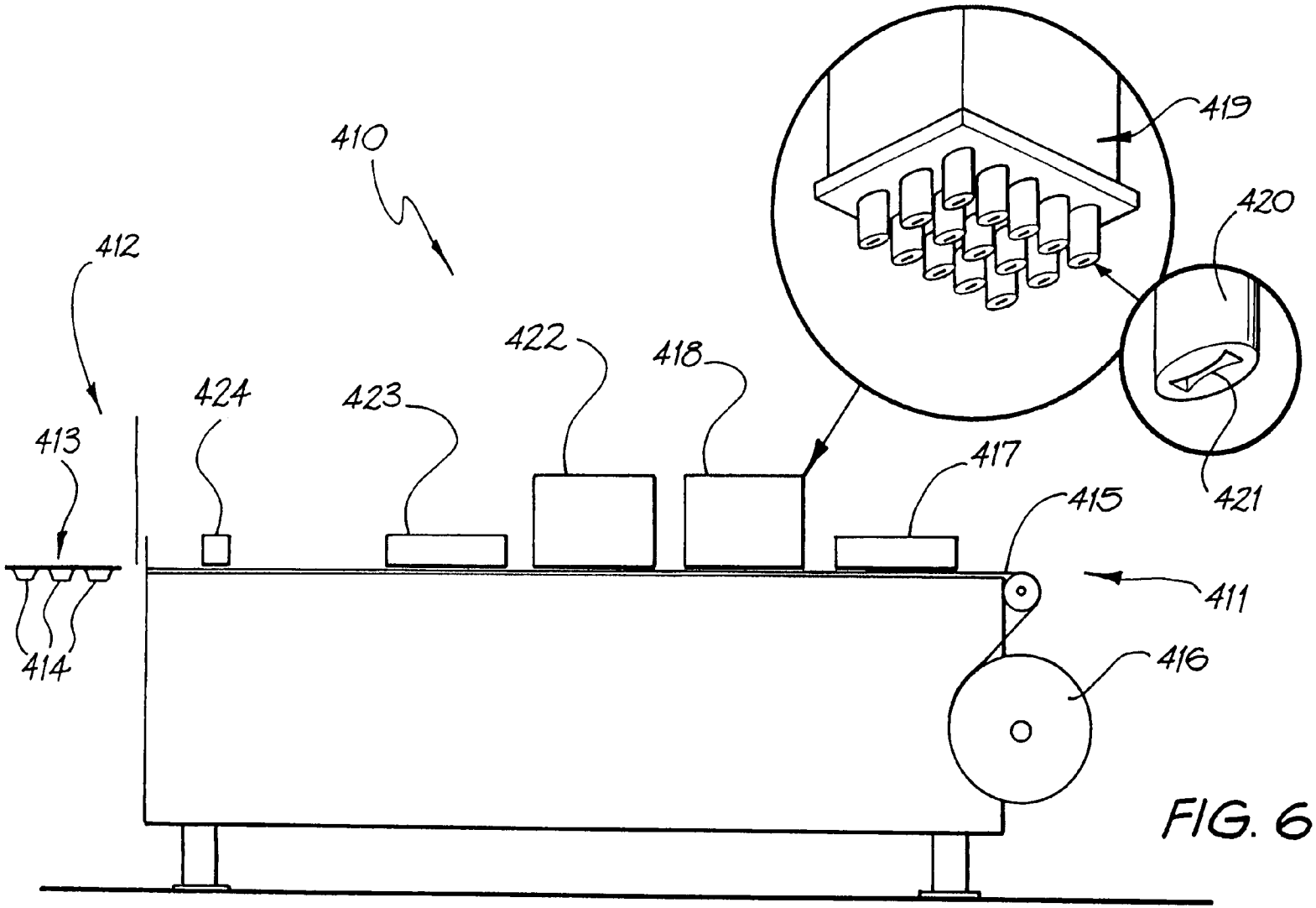
FIG. 6 illustrates a machinery arrangement suitable for the construction and filling of sachets according to various embodiments of the invention on a commercial basis.

With reference to FIGS. 5 and 6 a preferred method of manufacture of the sachets 10, 22 of various embodiments of the invention will now be described.

FIG. 5 illustrates the manner of interconnection of a lower sheet assembly 310 with an upper sheet assembly 311. In this instance each sheet assembly comprises an array 5 wide by 3 deep of what will become individual sachets.

Lower sheet assembly 310 commences as a plain sheet into which an array of indentations 312 are formed, which indentations will subsequently become tray portions 11 of the finished product.

Upper sheet assembly 311 comprises a corresponding array of cover portions 313 which are adapted to overlay and subsequently be attached to peripheral portions 314 of indentations 312.

Upper sheet assembly 311 comprises a 5×3 array of cover portions 313 formed contiguously within contiguous second upper film 315 which, in turn, overlays and is attached to contiguous semi-rigid material sheet layer 316. For display purposes a contiguous indicia layer 317 overlays and is attached to the contiguous semi-rigid material sheet layer as illustrated in FIG. 5. In the alternative or in addition a contiguous layer corresponding to overlay layer 23 of the second generalized embodiment previously described can overlay contiguous indicia layer 317.

In this instance the cover portions 313 include second sub-aperture region 21 within and forming part of contiguous second upper film layer 315.

In production lower sheet assembly 310 has formed within it by vacuum forming process or otherwise indentations 312 which are then filled with a flowable substance by filling means (not shown in FIG. 5). Following filling upper sheet assembly 311 is overlaid over lower sheet assembly 310 such that corresponding cover portions 313 are aligned with and cover squarely corresponding indentations 312 of lower sheet assembly 310.

The overlaid and juxtaposed lower sheet assembly 310 together with upper sheet assembly 311 are then passed to a sealing station wherein peripheral portions 314 of the indentations 312 are non-releasably sealed to corresponding peripheral portions 318 of the respective cover portions 313 thereby to form an array of sachets 10, 22 each having a sealed storage volume 12 therein releasably sealed by composite releasably sealed structures 13, 24.

The individual sachets can then be separated by cutting means (not shown).

It will be appreciated that the production process thus described is a step-wise process rather than a continuous process. Alternatively it can be viewed as a batch process wherein batches of sachets are formed, in this instance in arrays of 15 sachets at a time.

With reference to FIG. 6 a specific machinery layout to give effect to the general process described with respect to FIG. 5 will now be described.

Batch forming machine 410 comprises a plurality of serially aligned stations through which work in progress moves from an input end 411 to an output end 412 from which emerges separated arrays 413 of filled sachets 414.

Construction and operation of the machine 410 is as follows:

Film which is to form the first lower film layer 405 is taken from film roll 416 and fed into forming station 417 which, in this instance, is a vacuum forming station which forms 5×3 arrays of indentations 312 as described with reference to FIG. 5.

Each array thus formed is passed to a dispense fill station 418 where an injector array 419 (refer inset) is caused to place an injector nozzle above each indentation 312 of the array and to simultaneously inject into each indentation 312 a predetermined portion of flowable product. Each injector nozzle 420 includes a feed aperture 421 which is shaped so as to optimize flow characteristics for the selected flowable material. In the case of semi-viscous materials such as creams it has been found advantageous to have feed aperture 421 narrowed at its center as illustrated in cross-section in the inset of FIG. 6.

Once the array of indentations 312 has been filled with flowable material the array passes to a pick and place station 422 where upper sheet assembly 311 (refer FIG. 5) is placed over the top of and down onto the array of indentations 312 in first lower film layer 415. A preliminary join of at least part of upper sheet assembly 311 to lower film layer 415 can be made at this time to ensure alignment between the upper sheet assembly 311 and lower sheet assembly 310 is not dislodged during subsequent movement.

The assembled upper sheet assembly 311 and lower sheet assembly 310 then pass to sealing station 423 where, in this instance, peripheral portions 314 of lower sheet assembly 310 are contiguously heat sealed to peripheral portions 318 of upper sheet assembly 311 so as to form a non-releasably sealable join of the type described in relation to peripheral portions 14 of FIGS. 1 and 2 thereby to seal storage volume 12 complete with its flowable substance 16 therein.

A flying knife 424 is then utilized to separate the completed array 413 from the array still under formation.

Third Detailed Embodiment

Figure 7:
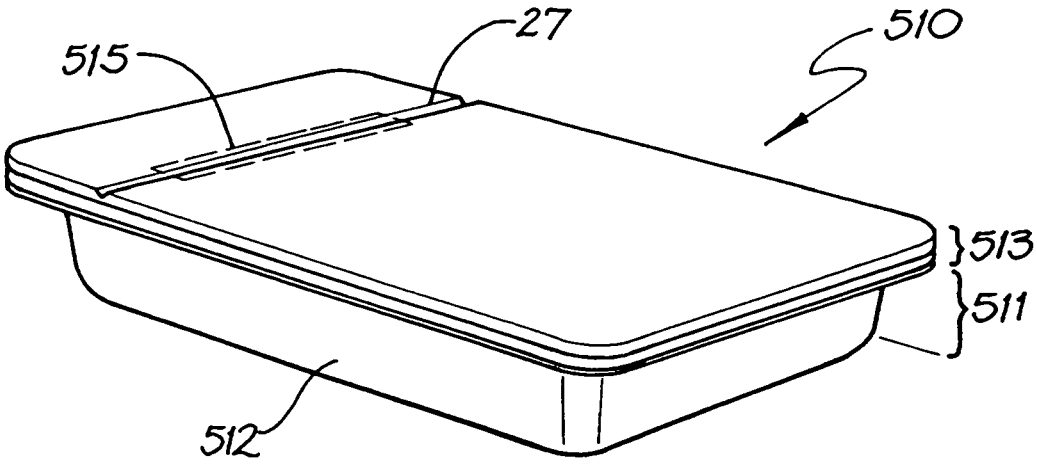
FIG. 7 is a perspective view of a sachet according to a further specific embodiment of the present invention particularly suited for the storage and expulsion of items.

With reference to FIG. 7 there is illustrated a sachet 510. In this arrangement the structure is the same as that described with reference to FIG. 1 and wherein like components are numbered as for FIG. 1 except in the 500 series. So, for example, tray portion 11 of FIG. 1 becomes tray portion 511 in this embodiment.

In the specific arrangement of FIG. 7 the sachet 510 includes an aperture region 515 in the form of an elongate slot which extends substantially the entire width of the composite releasably sealable structure 513. This arrangement permits the expulsion of stored items as well as flowable substances. So, for example, the sachet 510 can be utilized to store impregnated tissues or swabs which can be released by the same action as described with reference to the first and second preferred embodiments but which allows for a much larger aperture for the removal of items from the sachet 510.

Figure 8:
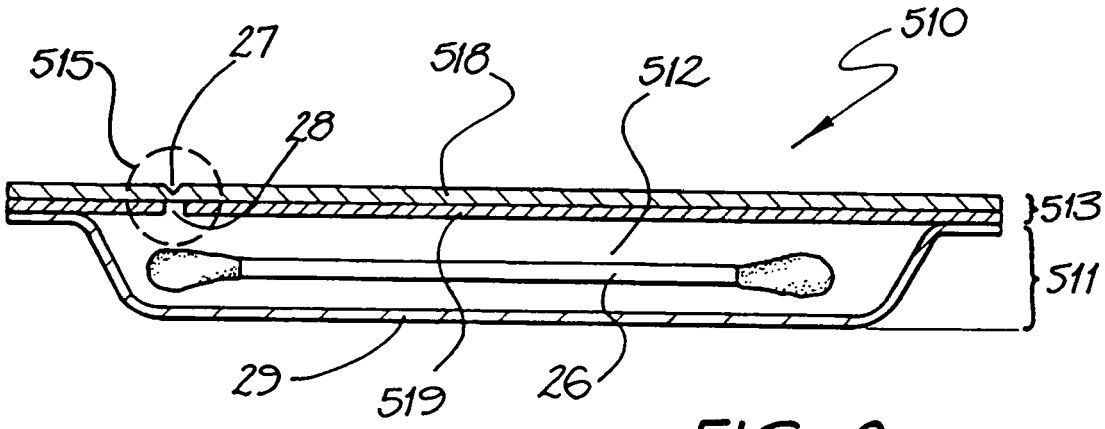
FIG. 8 is a side section view of the sachet of FIG. 7.

FIG. 8 is a side section view of the sachet 510 of FIG. 7 and showing the storage therein of a semi-rigid applicator 26 such as a cotton bud or the like. The composite releasably sealable structure 513 comprises semi-rigid member 518 in the form of high impact polystyrene with a printed layer on top and a score line 27 therein extending substantially the entire width of the semi-rigid member 518 and forming part of the aperture region 515.

Second upper film layer 519 comprises a heat bonded film and includes either an aperture or a rupturable aperture 28 therein also forming part of the aperture region 515.

The tray portion 511 is formed from a vacuum formed film 29.

Figure 9:
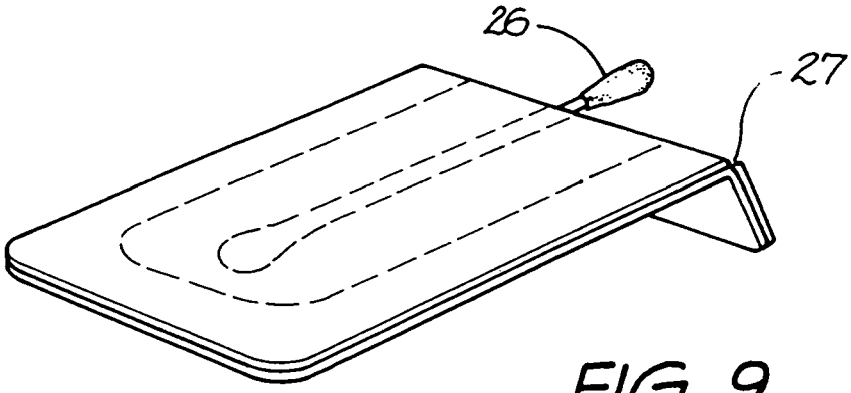
FIG. 9 is a perspective view of the sachet of FIG. 7 in a release or expulsion position.

As illustrated in FIG. 9 the aperture region 515 is ruptured by a bending of opposed ends of the sachet 510 as illustrated and allowing, in this instance, the item comprising semi-rigid applicator 26 to extend therefrom for easy removal. An advantage of this particular arrangement is that the semi-rigid applicator 26 can be removed for use or, alternatively, can be left with a portion of it remaining in the pack and held by the sachet 510.

Alternative Method of Manufacture

Figure 10:
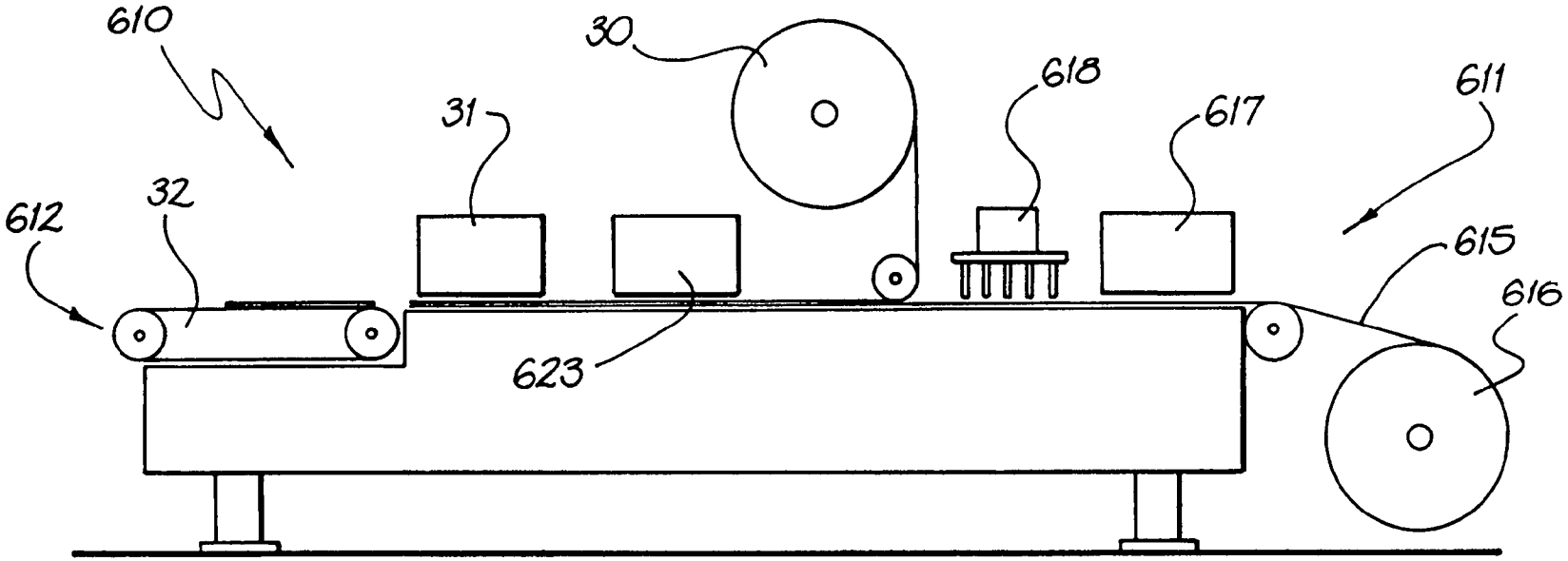
FIG. 10 is a diagrammatic view of an alternative machinery arrangement suitable for the construction and filling of sachets according to various embodiments of the invention on a commercial basis.

FIG. 10 illustrates a forming machine 610 suitable for the manufacture of sachets in accordance with the various embodiments of the invention previously described. In FIG. 10 like components are numbered as for the forming machine of FIG. 6 but in the 600 series. So, for example, the forming machine 410 of FIG. 6 is designated as a forming machine 610 in accordance with the second embodiment in FIG. 10.

The arrangement of FIG. 10 operates in the same manner as the arrangement of FIG. 6 except for the following:

In place of the pick and place station 422 the upper sheet assemblies 311 (refer FIG. 5) are fed as a continuous roll 30 thereby obviating the requirement for a pick and place mechanism. In each batch cycle of the machine the roll 30 simply unrolls sufficiently to allow an array of cover portions 313 to be placed over a corresponding array of indentations 312 in lower sheet assembly 310 for passing to sealing station 623 where sealing is performed as for the first embodiment described with reference to FIG. 6.

The array is then passed to a die cutting station 31 wherein the individual sachets are severed one from the other prior to deposit onto off feed conveyor 32.

Figure 11:
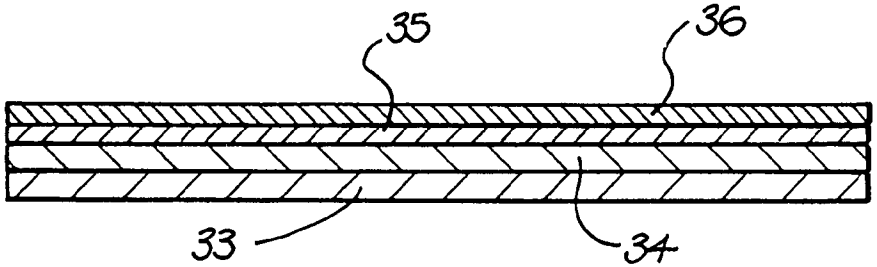
FIG. 11 is a side section view of a typical film structure usable as at least one of the layers in one or more of the above mentioned embodiments.

A particular form of film structure which can be utilized to form one or more of the film layers of the sachet and which can be utilized in conjunction with the methods of manufacture described thus far is illustrated in FIG. 11 in cross section. In this instance the film structure comprises a sealing layer 33 which can comprise, for example, LLDPE or can be comprised of LDPE or a co-extrusion thereof. Above sealing layer 33 is barrier film layer 34 which can be comprised of, for example, EVOH or PVdC coated PVC or metalised PE or aluminium foil.

Above the barrier film layer 34 can be an adhesive layer 35 comprised, for example, of LLDPE to which is adhered a top (usually printable) layer 36 which can comprise, for example, polyester or nylon.

The above describes only some embodiments of the present invention and modifications, obvious to those skilled in the art, can be made thereto without departing from the scope and spirit of the present invention.

For example it will be understood that the nozzle arrangement utilized for injecting flowable material into the sachets during manufacture may take other forms depending on the material and nature and direction of injection.

Similarly whilst the batch process is described with reference to a 3×5 array, other array sizes can be utilized.

Similarly, other forming methods may be utilized including press forming depending on the sachet materials utilized.

INDUSTRIAL APPLICABILITY

The sachet and its method of construction are applicable to the storage and subsequent selective release of selected items and various flowable materials including, but not limited to, single serves or portions of condiments, cosmetics, creams and the like.

The invention claimed is:

1. A sachet comprising:

a tray portion to which is non-releasably sealably affixed a composite releasably sealable structure; said composite releasably sealable structure comprising:

at least a first layer overlaying a second layer; said first layer comprising a semi-rigid member and said second layer comprising a film layer; said composite releasably sealable structure including an aperture region therein; said aperture region comprising a first sub-aperture region in said first layer in communication with a second sub-aperture region located in said second layer; said second sub-aperture region comprising a rupturable portion of the second layer such that, upon a first rupture of the aperture region, the second sub-aperture ruptures to form a releasably sealable channel and wherein said first layer is sealed to said second layer around said aperture region to form an annular seal surrounding said aperture region; said annular seal remaining intact after the first rupture of said aperture region.

2. The sachet of claim 1, further comprising a second upper film layer arranged on said first layer.

3. The sachet of claim 1 wherein said first sub-aperture region comprises a score line in said first layer.

4. A method of forming a sachet, said sachet comprising a first film layer to which is non-releasably sealably affixed a composite releasably sealable structure; said composite releasably sealable structure comprising a semi-rigid member and a second film layer; said composite releasably sealable structure including an aperture region therein; said aperture region comprising a first sub-aperture region in said semi-rigid member in communication with a second sub-aperture region located in said second film layer; said second sub-aperture region comprising a rupturable region of the second film layer and wherein the semi-rigid member is arranged such that the semi-rigid member is arranged externally to the second film layer; said method comprising the steps of:

a. forming an annular seal between the semi-rigid member and the second film layer about the rupturable region;

b. forming an array of indentations in the first film layer, each indentation defining a tray portion;

c. injecting a flowable substance into said indentations;

d. placing said composite releasably sealable structure over said array of indentations;

e. non-releasably sealing peripheral portions of said indentations to said composite releasably sealable structure thereby to form an array of sachets.

5. The method of claim 4 wherein said steps are performed in a batch mode.

6. The sachet of claim 1, wherein the second sub-aperture region defines a generally annular rupturable region of said film component.

7. The sachet of claim 6, wherein the second sub-aperture is generally circularly annular and is generally centrally arranged in the second layer.

8. The method of claim 4, further comprising forming the second sub-apertures as annular rupturable regions in the second film layer generally centrally arranged with respect to the tray portions.

* * * * *

UNITED STATES PATENT AND TRADEMARK OFFICE

CERTIFICATE OF CORRECTION

PATENT NO. : 7,121,409 B1
APPLICATION NO. : 10/070870
DATED : October 17, 2006
INVENTOR(S) : Hamilton et al.

It is certified that error appears in the above-identified patent and that said Letters Patent is hereby corrected as shown below:

At the First Page, Column 2, item (57) (in the Abstract)

Please delete "A sachet [(10, 22, 110, 210, 510)] for the packaging and dispensing of an item or a flowable substance [(125)], such as a liquid, powder or paste, has a semi-rigid member [(112)] with a weakened region [(120)] formed thereon so that upon bending across the weakened region [(120)] the semi-rigid member [(112)] will fracture along the weakened region [(120)]. The sachet [(110)] also has a reservoir [(114)] formed by overlaid first and second flexible film layers [(116, 118)] which are adapted to contain the flowable substance [(125)]. In one form, an annular region [(128)] of the second flexible film layer [(118)] immediately surrounding the aperture region [(126)] is sealed to the adjacent region of the semi-rigid member [(112)] so as to prevent leakage of the flowable substance [(125)] from within the reservoir [(114)]. In use, fracturing along the weakened region [(120)] will expose the aperture [(126)] so as to allow the flowable substance [(125)] to be dispensed."

and insert -- A sachet for the packaging and dispensing of an item or a flowable substance, such as a liquid, powder or paste, has a semi-rigid member with a weakened region formed thereon so that upon bending across the weakened region the semi-rigid member will fracture along the weakened region. The sachet also has a reservoir formed by overlaid first and second flexible film layers which are adapted to contain the flowable substance. In one form, an annular region of the second flexible film layer immediately surrounding the aperture region is sealed to the adjacent region of the

UNITED STATES PATENT AND TRADEMARK OFFICE

CERTIFICATE OF CORRECTION

PATENT NO. : 7,121,409 B1
APPLICATION NO. : 10/070870
DATED : October 17, 2006
INVENTOR(S) : Hamilton et al.

It is certified that error appears in the above-identified patent and that said Letters Patent is hereby corrected as shown below:

At the First Page, Column 2, item (57) (in the Abstract) (cont'd)

semi-rigid member so as to prevent leakage of the flowable substance from within the reservoir. In use, fracturing along the weakened region will expose the aperture so as to allow the flowable substance to be dispensed. -- therefor.

At Column 3, line 35 (approx.)

After "overlaying a" please delete "20".

Signed and Sealed this

Fourteenth Day of August, 2007

JON W. DUDAS
*Director of the United States Patent and Trademark Office*